United States Patent [19]

Halicho

[11] Patent Number: 4,468,134

[45] Date of Patent: Aug. 28, 1984

[54] WATCH BEZEL/LENS/ROCKER SWITCH ASSEMBLY

[75] Inventor: James J. Halicho, Sunnyvale, Calif.

[73] Assignee: Timex Corporation, Waterbury, Conn.

[21] Appl. No.: 387,069

[22] Filed: Jun. 10, 1982

[51] Int. Cl.[3] ..... G04B 37/00; G04B 27/02

[52] U.S. Cl. ..... 368/309; 368/69; 368/308

[58] Field of Search ..... 368/223, 294, 281, 319, 368/69, 308, 309; 200/339

[56] References Cited

U.S. PATENT DOCUMENTS

| | | | |
|---|---|---|---|
| 3,307,346 | 3/1967 | Klingenberg | 368/294 |
| 3,973,099 | 8/1976 | Morris, Sr. | 368/208 |
| 4,023,002 | 5/1977 | Wuthrich et al. | 200/302 |
| 4,184,321 | 1/1980 | Tarusawa | 368/281 |
| 4,201,043 | 5/1980 | Tarusawa | 368/294 |
| 4,320,481 | 3/1982 | Hofert | 368/319 |
| 4,362,397 | 12/1982 | Klingenberg | 368/233 |
| 4,386,254 | 5/1983 | Eberhardt et al. | 200/339 |

*Primary Examiner*—Bernard Roskoski

*Attorney, Agent, or Firm*—William C. Crutcher; Joseph A. Biela

[57] ABSTRACT

A watch assembly is disclosed which includes a watchcase that has frames along opposite sides which define the perimeter of the watchcase platform on which is mounted a crystal having at least one opening which receives a rocker switch for controlling watch functions. The recess formed by the opening in the crystal when the crystal is attached by adhesion substantially to the entire top surface of the watchcase platform has at least one hole at the bottom of the recess to provide for the rocker switch to have access to at least one switch contact inside the case. The rocker switch includes a manually-operated actuator arm disposed in the recess and having at least one projecting leg extending through at least one hole in the platform in the watchcase to actuate at least one switch contact mounted on a timekeeping circuitry module inside the case. Resilient washers which are disposed about the legs of the actuator arm seal off the inside of the watchcase from the outside of the watchcase when the rocker switch is properly seated in the recess. The resilient washers also provide for spacing and for return of the actuator bar to its original position after it is pressed.

1 Claim, 10 Drawing Figures

WATCH BEZEL/LENS/ROCKER SWITCH ASSEMBLY

BACKGROUND OF THE INVENTION

In the use of electronic watches, particularly multifunctional digital watches, it is necessary to have switches which enable the user of the watch to select desired display functions, or to set the information being displayed or to illuminate the display by some external light source. In the past, electronic watches have often employed one or more pushbutton switches to control the watch functions. These pushbuttons most often employ a dynamic seal which is necessary to minimize or prevent moisture or other contaminants from entering into the interior of the watch where delicate electronic components can be adversely affected.

Typically, the pushbutton assembly includes a tube having an axially tapered bore for receiving a plunger. An O-ring is disposed around the plunger and a spring is used to provide tension on the pushbutton. Typical prior art pushbuttons are shown in U.S. Pat. No. 3,575,212 to Zellweger et al. issued Sept. 11, 1973, U.S. Pat. No. 3,783,607 to Feurer issued Jan. 8, 1974 and U.S. Pat. No. 4,023,002 to Wuthrich issued May 10, 1977 among others. Switches of the typical pushbutton type are not advantageous in that they are relatively high in cost, provide inadequate sealing and detract from the overall appearance of the watch.

A pushbutton switch which overcame these deficiencies is described in U.S. Pat. No. 4,031,348 issued to Eberhardt on June 21, 1977. This switch comprises a single pushbutton member which includes a button and a shaft, the shaft being disposed within a bore and a counterbore in a watchcase. A resilient, annular washer is disposed about the shaft of the pushbutton member within the counterbore and is shaped to provide sealing engagement with the counterbore and pushbutton. The washer also functions as both a seal and return spring for returning the pushbutton to its initial position after actuation.

Other types of switches for electronic watches have been developed in the prior art. For example, a thin touch-type switch is disclosed in U.S. Pat. No. 4,241,246 issued to Lugaresi on Dec. 23, 1980. Switch constructions for electronic calculator watches are disclosed in U.S. Pat. No. 4,072,004 to Tanaka et al. issued issued Feb. 7, 1978 and in U.S. Pat. No. 4,184,321 issued to Tarusawa on Jan. 22, 1980.

Switch constructions apparently for other uses are disclosed in the following patents: U.S. Pat. No. 3,999,287 issued to Lockhard discloses a rocker switch in which a pair of spaced contacts are embedded in a rocker and resiliently grip a diode therebetween that controls current direction in the circuit; U.S. Pat. No. 4,121,074 issued to Orcutt et al. involves a pressure responsive switch incorporating a rocker member for operating on a contact arm; U.S. Pat. No. 4,172,973 issued to Sano discloses a seesaw switch light-emitting diode mounted on a rocker.

Copending U.S. patent application Ser. No. 273,786 entitled "Rocker Switch" filed on Jun. 15, 1981 in the names of Eberhardt and Carl and of common assignee herewith discloses a rocker switch useful for controlling the functions of an electronic watch. As adopted for use with a watch, the rocker switch is preferably disposed in a recess in a watch case and includes a manually operable actuator bar having a pair of spaced legs projecting through access holes into the watch case to engage switch contact means therein when the actuator bar is rocked. Each leg of the actuator bar includes an offset lip engaging the watch case from the inside to retain the actuator bar in the recess. Resilient washers are positioned around the actuator bar legs between the bar and the bottom of the watchcase recess to provide switch sealing and return-spring functions for the actuator bar.

Other attachments of the watch crystal or lens to the watchcase have been developed in the prior art. For example, the Ratajski U.S. Pat. No. 4,198,811 shows a flat watch crystal mounted between upstanding walls extending along opposite sides of the watchcase. U.S. Pat. No. De. 252,860 issued to Perrin appears to provide a similar case/crystal attachment arrangement.

SUMMARY OF INVENTION

A timepiece assembly having a watchcase, a watch crystal mounted on the case and at least one manually operable switch mounted on the case and accessible for manual switching through the crystal. The case and crystal include openings providing access to switch contact means disposed inside the watchcase and which receive at least one leg depending from a manually operable actuator bar of the manually operable switch to provide contact with at least one switch contact inside the watchcase. The crystal has at least one opening forming a recess within which the manually operable switch is disposed and the case has at least one opening in the bottom of the recess providing access to the inside of the watchcase. The crystal is attached to a platform on the top of the watchcase. The manually operable switch is retained in each recess by a retaining means and springs back into its initial position by resilient washer means after being pressed. Each resilient washer means is disposed around each leg of the switch and also provides a sealing action against moisture.

DESCRIPTION OF THE PREFERRED EMBODIMENT

Figure 1A:
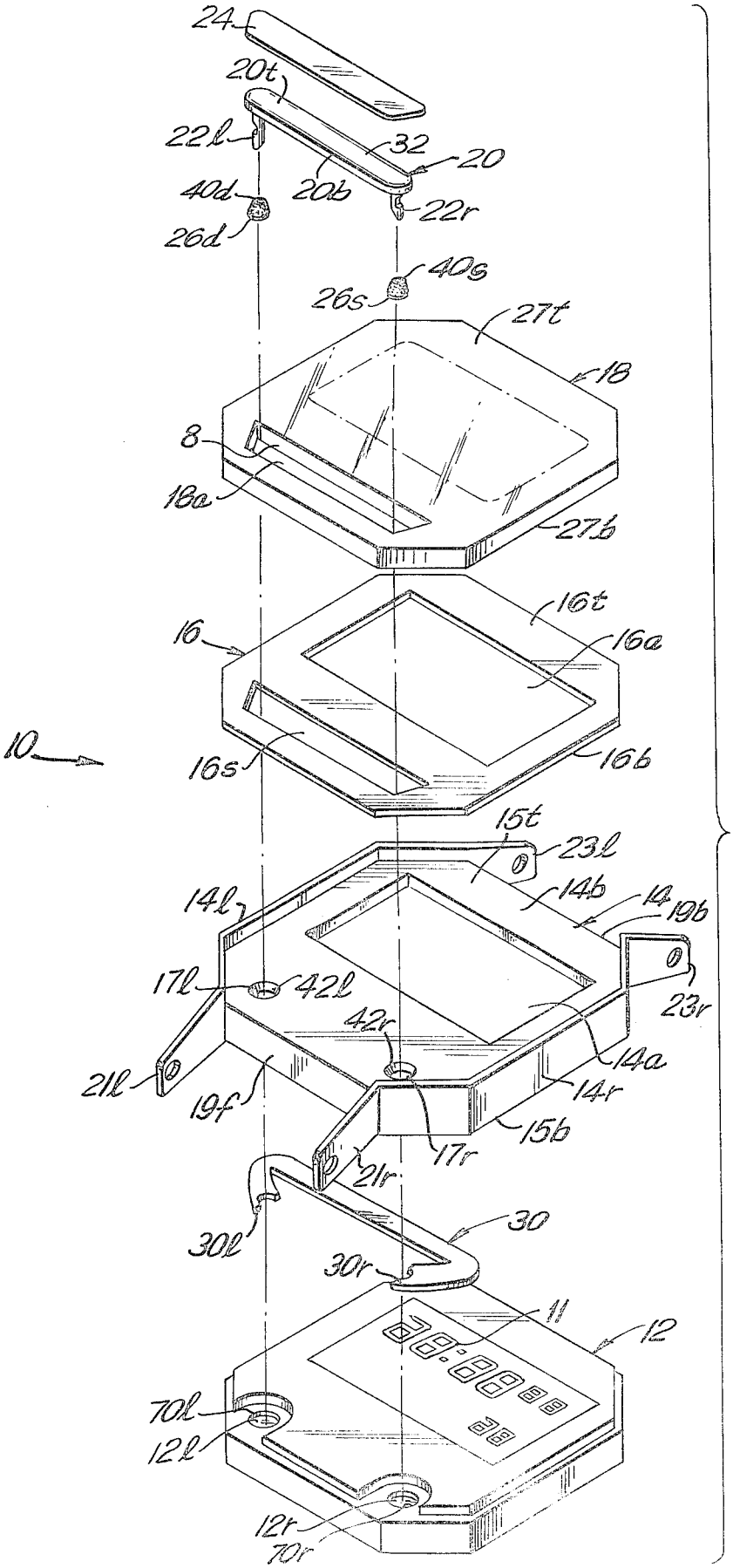
FIG. 1*a* is an exploded view of the watch assembly showing separately, but in relation to one another, the component parts of the watch.

Referring to FIG. 1*a* timepiece or watch assembly 10 is shown including timekeeping module 12, spring panel 30, watchcase or bezel 14, gasket 16, lens 18, seals 26*d* and 26*s*, rocker panel 20 and panel cap 24. Rocker panel 20 is appropriately pressed for making electrical contact with module 12 to provide for control of watch functions.

Bezel or watchcase 14 is shaped substantially octagonal with substantially smooth and rounded edges to provide for a pleasant appearance. The actual shape of the watchcase is not critical to the implementation of the invention such that watchcase 14 could be substantially in the shape of a square or rectangle. Bezel 14 includes a substantially octagonally shaped platform or base 14*b* having top surface 15*t* and bottom surface 15*b* and having at least one opening therein. In this embodiment, the base has three openings. First opening or aperture 14*a* is substantially rectangular in shape but not symmetrically positioned within the octagonal perimeter of base 14*b*. Second and third openings in the base include a pair of spaced-apart holes, 17*l* and 17*r*, having centers that lie on a line that is substantially parallel to two opposing edges of the bezel and, in particular, to the length of said rectangular aperture and within close proximity to one of the sides that represents the length of said aperture. Watchcase base 14*b* is molded along three contiguous edges to form left frame member 14*l* and along three opposing contiguous edges to form right frame member 14*r* wherein said frames substantially encompass an octagonal-shaped recess such that the top surface 15*t* of base 14*b* is the bottom of said octagonal-shaped recess. The two remaining opposing edges of the base, 19*f* and 19*b*, are parallel to one another and to the length of aperture 14*a* and, in this embodiment, are not molded to form frame members. In effect, in this embodiment, base 14*b* is open-ended at opposing edges 19*f* and 19*b* thus forming an open-ended recess.

Figure 3A:
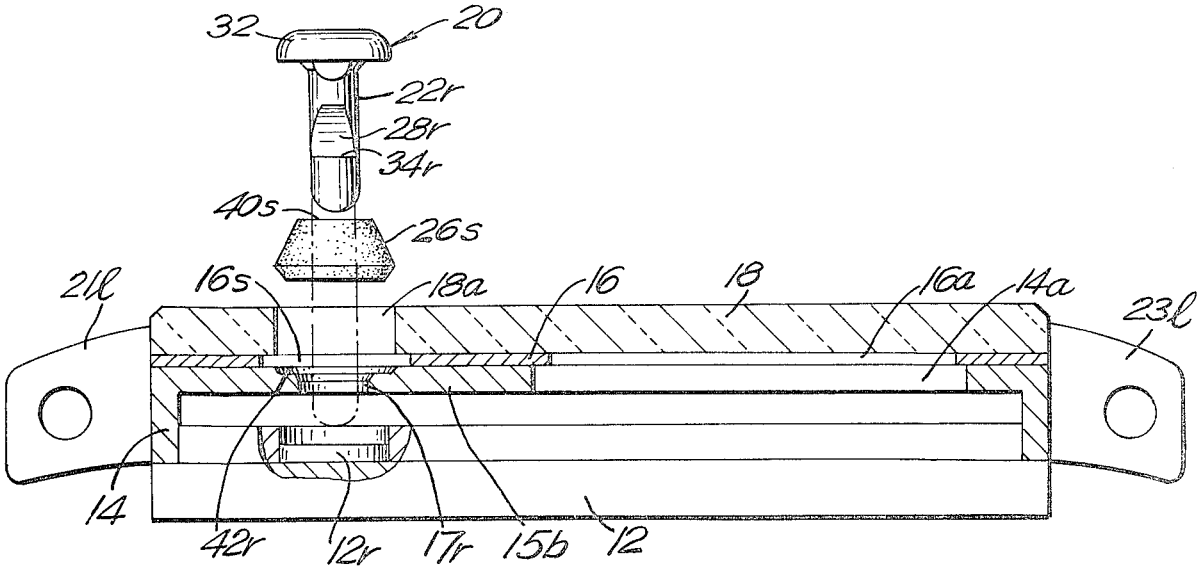
FIG. 3*a* is a partial cross-sectional view of the partially assembled watch components of FIG. 1 showing two components of the watch positioned with respect to each other and to the remainder of the partially assembled watch.

Both left and right frame members extend perpendicularly above and below the top and bottom surfaces of said watchcase base. End portions at each end of said frame members extend beyond base edges 19*f* and 19*b* and angle downward from top surface 15*t* of the base as shown in FIG. 3*a*. The end portions of said frame members that extent beyond base edge 19*f* form spaced-apart tabs 21*l* and 21*r* that are substantially parallel to one another. The end portions of said frame members that extend beyond base edge 19*b* form spaced-apart tabs 23*l* and 23*r* which are substantially parallel to each other. Tabs 21*l* and 21*r* extend substantially perpendicularly from edge 19*f* forming a recess with respect to base edge 19*f* to receive, for rotatable attachment, one end of a watch strap or band. Tabs 23*l* and 23*r* extend substantially perpendicularly from edge 19*b* forming a recess with respect to base edge 19*b* that receives, for rotatable attachment, the opposite end of the watchband or strap. Each tab may have notches, grooves or holes to provide for conventional attachment of a watchband.

Gasket 16 is substantially octagonally shaped, includes top surface 16*t* and bottom surface 16*b* on which are coated pressure sensitive adhesive film. Double-sided adhesive gasket 16 has at least one opening including rectangular shaped window 16*a* and substantially trapezoidally shaped slot 16*s* the bases of which are parallel to two opposing edges of the gasket and, in particular, to the length of window 16*a*. The adhesive gasket covers substantially all of the solid surface area of the bezel platform, but not the openings, to provide a sealant against moisture from entering the watchcase in the area of the module. Use of adhesive gasket 16 eliminates the need for any other sealing-type gasket.

Figure 1B:
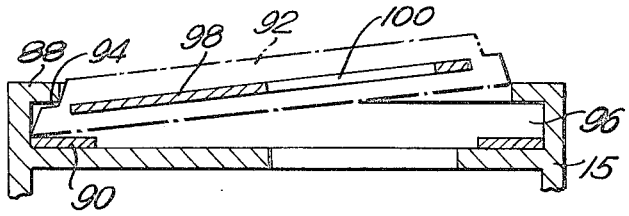
FIG. 1*b* is a cross-sectional view showing the watch crystal snap-fitted to the bezel.

Crystal or lens 18 is substantially octagonal in shape and has at least one opening. The crystal may be made of molded acrylic which is color transparent and may also have beveled edges. Crystal 18 has opening 18*a* which is substantially trapezoidally shaped with bases that are parallel to two opposing edges of the crystal and to the bases of slot 16*s* in gasket 16. The crystal includes top surface 27*t* and bottom surface 27*b*. In one preferred embodiment, to prevent the interior of the watchcase from being seen through the crystal, the crystal may be molded around masking insert 98 as shown in FIG. 1*b*. The mask provides mask opening 100 for viewing display 11 in module 12. A mask may also be provided by painting the lens or attaching a mask to the side thereof.

Module 10 includes conventional timekeeping components of the watch such as time display 11 and has positioned thereon spaced-apart electrical switch contacts 12*l* and 12*r*. The display must be seen clearly through the openings in at least two watch assembly components including aperature 14*a* in bezel 14 and window 16*a* in gasket 16 as well as through crystal 18 without being obstructed from view.

Figure 2:
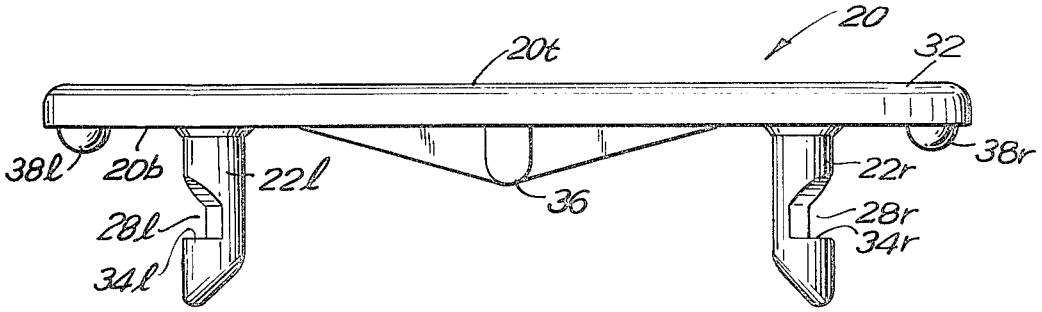
FIG. 2 is a lateral view of the rocker panel which is a component part of the watch assembly shown in FIG. 1.
Figure 8:
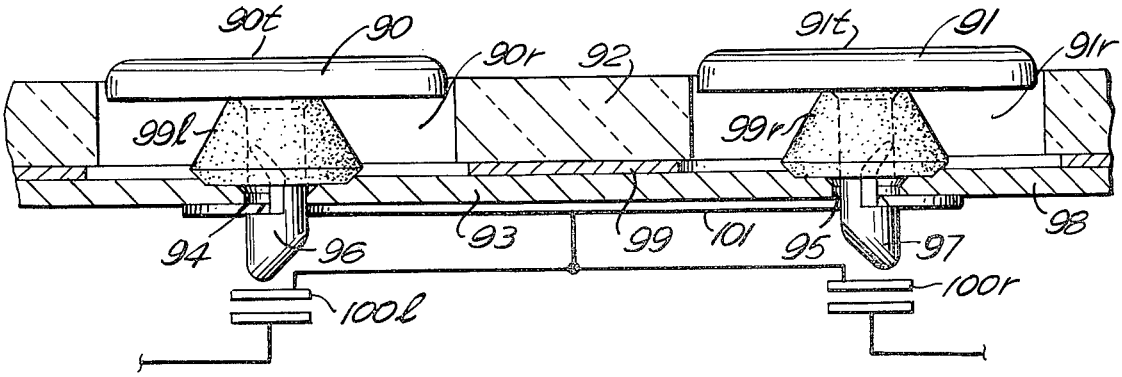
FIG. 8 is a cross-sectional view showing the assembled components of the watch assembly having more than one actuator bar.

Rocker panel 20 which is shown in FIG. 2 is a rocker-type switch that is preferably of the type disclosed in copending U.S. patent application "Rocker-Switch" filed in the names of Eberhardt and Carl as inventors and of common assignee herewith. The panel, which may be made of die cast zinc or plastic coated with a clear irridite finish, is substantially trapezoidal in shape and includes two spaced-apart legs 22*l* and 22*r* depending from base 20*b* of actuator bar 32 of rocker panel 20. It is understood that, in another embodiment, the two spaced-apart legs can depend from independent, non-communicating actuator bars forming two separate push button type switches as shown in FIG. 8 rather than the rocker type switch of the present invention. Cap 24, which is substantially the same shape as panel 20, is provided as a decorative cover for panel top 20*t* and in no obvious way affects the function of rocker panel 10. Seals 26*d* and 26*s* are substantially conically shaped and exhibit elastic properties to withstand compressive forces. To obtain the elastic properties, the seals may be made of silicon rubber material. The seals or resilient annular washers each have openings to receive one of said depending legs of panel 20. Spring panel 30 is a thin, substantially "u"-shaped flexible metal strip which is formed to engage a portion of each leg of panel 20. Parallel members 30*l* and 30*r* of the "u"-shaped spring panel removably engage legs 22*d* and 22*r*, respectively, for retaining the rocker panel to the bezel.

It is understood that the overall geometrical characteristics of each of the components of watch assembly 10 are not critical to the implementation of the invention. For example rounded or angular edges of bezel 14 may be modified without materially altering or defeating the invention that is disclosed and claimed. However, alignment of legs 22*l* and 22*r* of rocker switch 20 with bezel holes 17*l* and 17*r*, respectively, is required for proper operation of the assembled watch. Furthermore, alignment of crystal opening 18*a* with slot 16*s* in gasket 16 must be made within predetermined tolerances in order to receive the vertically movable rocker switch for proper control of watch functions.

Figure 3B:
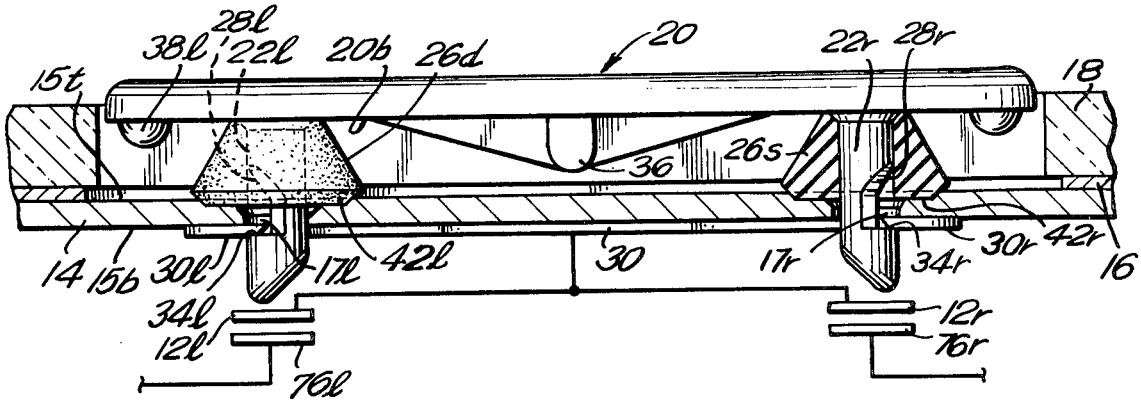
FIG. 3*b* is a cross-sectional view showing the assembled components of the watch assembly of FIG. 1.

Watch assembly 10 is assembled by removably coupling module 12 to said left and right frames and below bottom surface 15*b* of bezel 14 so that switch contacts 12*l* and 12*r* are aligned substantially directly underneath holes 17*l* and 17*r*, respectively, as shown in FIG. 3*b*. Top adhesive surface 16*t* of said gasket is securely attached to bottom surface 27*b* of crystal 18 such that slot 16*s* in gasket 16 is properly aligned with and directly underneath crystal opening 18*a*. Bottom adhesive surface 16*b* of said gasket is securely attached to the top surface 15*t* of bezel 14 such that slot 16*s* substantially symmetrically encloses but does not cover bezel holes 17*l* and 17*r*.

The crystal may be connected to the bezel in a number of ways to include snaps and epoxies as well as with material having adhesive properties. For example, an adhesive paste-like substance may be applied to the bottom surface of the crystal by roller or brush for attaching the crystal to the top surface of the bezel. Also narrow strips of doubly-coated adhesive tape may be used to secure the crystal to the bezel and yet prevent moisture from reaching the module inside the watch case under the bottom surface of the bezel. It is preferable to provide a means of connecting the lens to the watchcase for providing a moisture barrier between the exterior of the watchcase and the interior of the watchcase. Such means would include a doubly-coated adhesive gasket or epoxy material. In another embodiment, FIG. 1*b* shows a frame member having an inwardly extending flange 88 at the top of the frame distal to the top surface of the base of bezel 15. Sealing gasket 90 is positioned around the base of the bezel substantially along the perimeter of the base. Watch lens 92 includes a lateral lip 94 which is snap-fitted in the channel 96 formed between flange 88 and sealing gasket 90. The dimensions and shape of the components are selected such that the gasket is compressed when the crystal is snap-fitted to the watchcase or bezel. Snap-fitting is performed by simply positioning one lip of the crystal in the space between flange 88 and gasket 90 and pushing the other lip down into channel 96.

In either case, crystal 18 is snugly fitted and mounted entirely within the perimeter defined by bezel frame members 14*l* and 14*r* on the entire top surface 15*t* of bezel base 14*b* giving an all-glass appearance to the assembled watch. Proper alignment of window 16*a* of gasket 16 must be made with respect to bezel aperture 14*a* such that no part of the adhesive gasket obstructs the aperture in such a way that would prevent viewing display 11 thru said aperture. Cap 24 is coupled to panel 20 over top surface 20*t* by, for example, a double-coated adhesive strip. Depending leg 22*l* is received by opening 40*d* in demand seal 26*d* and depending leg 22*r* is received by opening 40*s* in said seal 26*s*. The seals are positioned around and encompass at least a portion of each substantially cylindrical leg. The largest outside diameter of each seal must be larger than the diameter of each of said holes in said bezel.

The partly assembled combination including cap, panel, legs and seals is received by the recess formed by opening 18*a* in crystal 18 and slot 16*s* in gasket 16. Wall 8 of the crystal recess is formed by the edges defining opening 18*a* in the crystal together with the edges of slots 16*s* in the gasket and the depth of the recess and, therefore, the height of the wall is substantially equivalent to the combined thickness of the gasket and the crystal. Cap 24 with panel 20 have sufficient clearance from the walls of the crystal recess to allow for slight misalignment of holes 17*l* and 17*r* with respect to depending legs 22*l* and 22*r* respectively. The axial dimension of each washer is predetermined with respect to the distance between the bottom surface 20*b* of panel 20 and the top surface 15*t* of the base of bezel 14. Legs 22*l* and 22*r* extend through washers 26*d* and 26*s* into and, at least partly, through holes 17*l* and 17*r*, respectively, in base 14*b*. Each washer is slightly compressed between panel 20 and the top surface of the base 14*b* for sealing off said holes in bezel 14. Spring panel 30 is removably connected to the portion of each leg that extends through each hole. FIG. 3*a* shows leg 22*r* being received by openings 40*s* in washer 26*s* and then both leg and washer being received by the recess formed by opening 18*a* and slot 16*s*. FIG. 3*b* shows both legs and washers in proper assembled position with the end of each leg distal to panel base 20*b* extending through their respective holes.

Rocker panel or switch 20 is shown in more detail, but without cap 24, in FIG. 2 and includes elongated, trapezoidally shaped manually-operable actuator bar 32 with accessible top surface 20*t* by which the bar is rocked. The actuator bar includes bottom surface 20*b* which faces the acutator bar recess formed by crystal opening 18*a* and gasket slots 16*s*. The bottom surface of the actuator bar is substantially parallel to the top surface 15*t* of base 14*b* of bezel 14. The top surface of the bezel base is the bottom of the actuator bar recess. Projecting legs 22*l* and 22*r* depend from bottom surface 20*b* and are received by and extend through holes 17*l* and 17*r* in the base of the actuator bar recess. The actuator bar recess is formed about the holes in the base of the bezel to provide for the rocker panel with depending legs to be received thereby so that the legs can be further received by the holes in the base of the bezel. The wall formed by the edge of the crystal around opening 18*a* and the edge of the gasket around slot 16*s* together define the sides of the recess. Each leg is substantially cylindrically shaped. Leg 22*l* includes a notch 28*l* that provides for an offset lip 34*l*. Leg 22*r* also includes a notch 28*r* that provides for an offset lip 34*r*. Notch 28*l* and notch 28*r* face away from each other to facilitate installing and engaging the panel with the base of the bezel. In one embodiment the end of each leg distal to panel base 20*b* is beveled to facilitate snap-fitting each leg to the interior wall of its respective hole such that each offset lip grips a portion of bottom surface 15*b* of bezel base 14*b* as shown in FIG. 3*b*. Each notch provides the space required for snap-fitting panel 20 directly to bezel 14. Spring panel 30 has spring members 30*l* and 30*r*, as shown in FIGS. 1*a* and 3*b*, which are attached to legs 22*l* and 22*r* between offset lip 34*l* and 34*r*, respectively, and bottom surface 15*b* and base 14*b* of bezel 14. Rocker panel 20 is movably secured to bezel 14 by spring members 30*l* and 30*r* of spring panel 30.

Positioned between depending legs 22*l* and 22*r* on the bottom surface 20*b* of the actuator bar is a central stop boss 36 which is provided for preventing simultaneous engagement of legs 22*b* and 22*r* with the switch contacts 12*l* and 12*r* of module 12 when setting a watch function. The curved surface of central stop boss 36 will butt against top surface 15*t* of bezel 14 when the actuator bar is improperly pressed on top surface 20*t*. Within close proximity to the opposite ends of the elongated actuator bar and outwardly disposed from legs 22*l* and 22*r* are travel limit bosses 38*l* and 38*r*, respectively, which limit the rocking movement of the actuator bar within predetermined limits. Travel limit bosses 38*l* and 38*r* protrude from bottom surface 20*d* of rocker panel 20. The purpose of the rocking panel is to provide a switch that can rock in one of two directions such that the shape of the panel and the corresponding recess formed by opening 18*a* and slot 16*s* which receives the panel may be of any desired shaped as long as the rocking movement can be implemented.

FIG. 3*a* shows the relative positions of leg 22*r* depending from rocker switch 20 and resilient annular washer 26*s* with respect to bezel 14 having tabs 21*l* and 32*l* extending therefrom including module 12, gasket 16 and crystal 18. Seal or washer 26*s* receives leg 22*r* through washer opening 40*s* for positioning washer 26*s* between top surface 15*t* of bezel 14 and bottom surface 20*b* of panel 20. The rocker panel 20 with washer 26*s* fits within the spaced defined by the recess formed by opening 18*a* in crystal 18 and slot 16*s* in gasket 16. The base of the conically shaped washer is snugly received by bezel recess 42*r* which is molded into the base of bezel 14 and surrounds hole 17*r*. Leg 22*r* is further received by hole 17*r* and extends therethrough as shown in FIG. 3*b*. Notch 22*r* allows leg 22*r* to engage bezel 14 by snap-fitting against the interior wall of hole 17*r*. A similar description of the connection of leg 22*l* to bezel 14 can be made. Another bezel recess 42*l* is molded into the base of bezel 14 and surrounds hole 17*l*. Each offset lip, 34*r* and 34*l*, permits the bezel to retain the rocker panel in recess 18*a*. Spring panel 30 secures panel 20 to bezel 14 and its flexibility allows the rocker panel to be pressed to engage the contacts of module 12 and thereafter to be returned to its initial position due to release of compression on the resilient washers.

FIG. 3*b* shows the relative positions of each of the components after the watch has been assembled. Washer 26*d* and 26*s* are made of resilient material such as silicone rubber to provide for the necessary sealing of holes 17*r* and 17*l* about legs 22*r* and 22*l*, respectively, and also to provide for the necessary spring action to return the rocker panel to its original position after one end or the other is pressed to make contact between either leg 22*r* and switch contact 12*r* or leg 22*l* and switch contact 12*l*. Of course, other washer configurations may be employed and these are illustrated in the copending application entitled "Rocker Switch" incorporated by reference herein above.

As shown in FIG. 3*b*, legs 22*l* and 22*r* are used to alternately make or break electrical contact with switch contacts 12*l* and 12*r*, respectively, for selectively controlling watch functions including seconds, timer, alarm, date and information, or for controlling lighting means to illuminate the display. Of course, only one switch contact may be sufficient for implementing switching using rocker switch 20, but is not considered an embodiment of this invention. The actuator bar 32 may be insulative molded plastic or conductive machine cast or stamped metal as required for the particular timekeeping circuitry selected. In addition, the actuator bar may be a complete molded panel or it may be formed of an assembly of one or more dependent parts including individual legs attached to a surface of the actuator bar.

Figure 7:
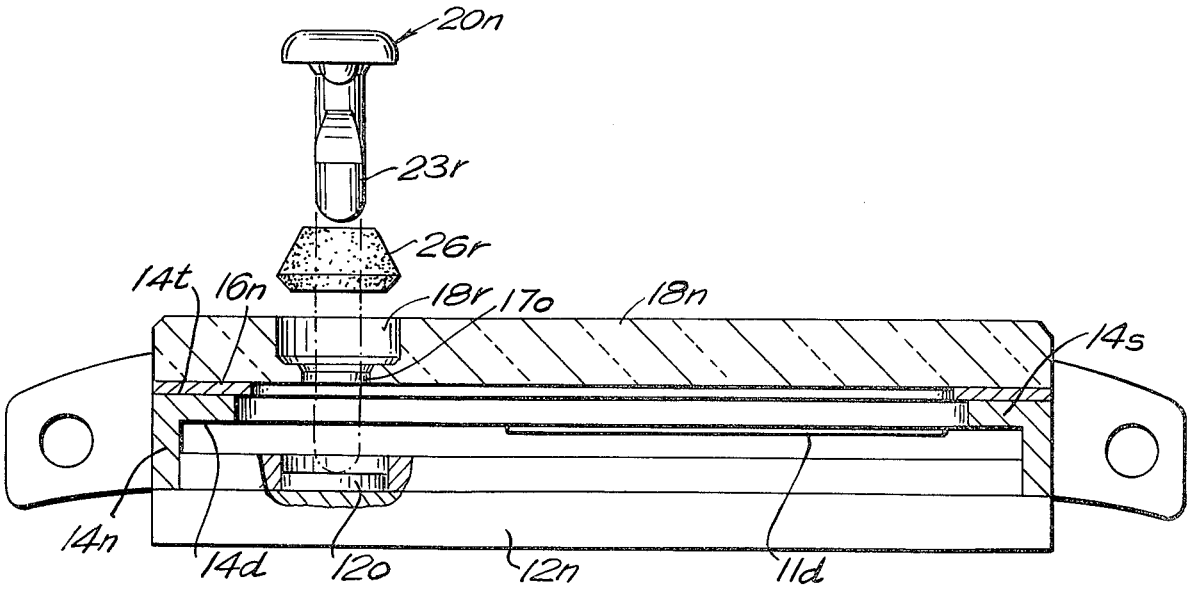
FIG. 7 is a partial cross-sectional view of the partially assembled watch components of FIG. 6 showing two components of the watch positioned with respect to each other and to the remainder of the partially assembled watch.

The actuator bar may include a variety of styles, especially on top surface 20*t* or cap 24 which is visible to the switch operator. These styles are shown in FIGS. 7 through 9 of the copending application referenced above. Of course, the color of the actuator bar may be coordinated with that of the lens, case, display, strap, band or other features of the watch.

Figure 4:
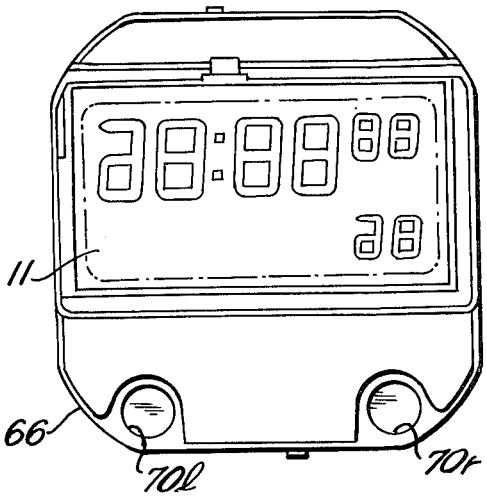
FIG. 4 is a top planar view of the module of FIG. 1.
Figure 5:
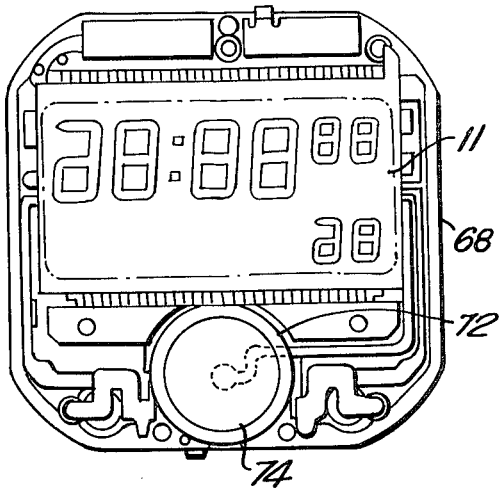
FIG. 5 is a top planar view of the module of FIG. 1 with the cover or front frame removed.

Module 12 includes front frame 66 and rear frame 68 as shown in FIGS. 4 and 5. The module is mounted in watchcase 14 as shown in FIG. 3*a*. The module has two openings 70*l* and 70*r* in the front frame. These are aligned with holes 17*l* and 17*r* in bezel 14 at the bottom of the recess formed by opening 18*a* and slot 16*s*. Depending legs 22*l* and 22*r* extend through said holes to engage switch contacts 12*l* and 12*r* mounted between the front and rear frames. The switch contacts are each in the form of thin flexible metallic wings extending from a substantially semicircular ring 72 which extends partially around and in contact with battery 74 as shown in FIG. 5. Positioned below switch contacts 12*l* and 12*r* are lower switch contacts 76*l* and 76*r* respectively which are in the form of circular metallic pads connected by appropriate leads to an integrated circuit chip (not shown) mounted on the bottom frame 68 beneath the electrooptical display 11 which may be a well known twisted nematic liquid crystal display. Switch contacts 12*l* and 12*r* are formed of a resilient metallic sheet such as spring temper Type 302 stainless steel so that they can be depressed into engagement with lower switch contacts 76*l* and 76*r* and yet return to the original position when the projecting leg of the actuator bar is withdrawn by return spring action of the resilient washers.

Although the embodiment described illustrates the rocker switch in a recess below the display in the watch lens for controlling watch functions, it is understood that the switch may be positioned in a recess substantially anywhere on the watch and still perform the function of rocker panel 20. In this preferred embodiment, the switching function of panel 20 is performed by pressing the switch either at one end or the other in its position in the watch crystal recess such that switching occurs directly through the crystal. The switch is received by crystal 18 and snap-fitted to base 14*b* of bezel 14. The lens has an opening through which the top surface 20*t* of switch 20 projects to allow for appropriately manually pressing the rocker switch to produce timekeeping functions. The crystal or lens has opening 18*a* that is large enough for actuator bar 32 to project through to allow for manually pressing the top surface of said bar for controlling watch functions.

Figure 6:
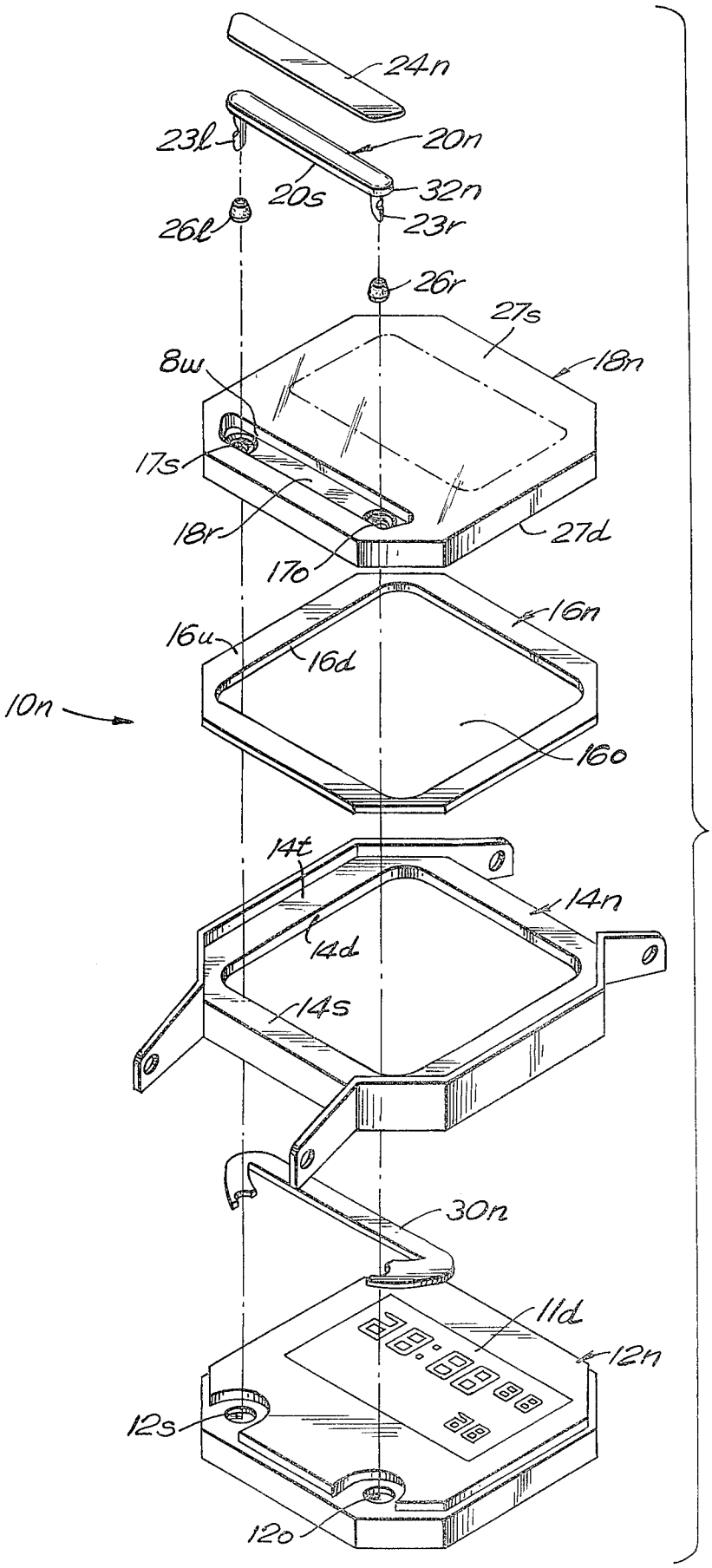
FIG. 6 is an exploded view of another embodiment of the watch assembly showing separately, but in relation to one another, the component parts of the watch.

In another embodiment of watch assembly 10*n* shown in FIGS. 6 and 7, base or platform 14*s* of bezel 14*n* has one opening 14*o*. Opening or aperture 14*o* is substantially rectangular in shape and substantially symmetrically positioned within platform 14*s*. Since opening 14*o* is large with respect to the area of platform 14*s*, the platform takes on the appearance of a shelf having top surface 14*t* and bottom surface 14*d*. Opening 14*o* is sufficiently large so as not to cover from view display 11*d* of module 12*n* and so as not to block off holes 17*s* and 17*o* in lens 18*n*.

Double-coated pressure sensitive film adhesive gasket 16*n*, in this embodiment, has only one opening 16*o* having substantially the shape of opening 14*o*. Gasket 16*n* has top surface 16*u* and bottom surface 16*d*.

Crystal or lens 18*n* has at least two holes, 17*s* and 70*o*, at the bottom of recess 18*r* formed by opening 18*o* in top surface 27*s* of the lens.

In the assembly of the components of the watch of this embodiment, bottom surface 16*d* of gasket 16*n* adheres to top surface of platform 14*t* while top surface of gasket 16*u* adheres to at least a portion of bottom surface 27*d* of lens 18*n* substantially as described in the initial embodiment. The gasket provides a watertight seal against moisture. Opening 16*o* in the gasket is sufficiently large so as not to cover the display 11*d* of module 12*n* and so as not to block off holes 17*s* and 17*o* in lens 18*n*.

Recess 18*r* receives panel rocker 20*n* in the manner previously described in the initial embodiment but legs 23*l* and 23*r* depending from bottom surface 20*s* of the panel rocker are received by holes 17*s* and 17*o* in lens 18*n* and not, as described in the first embodiment, by holes in the platform. Holes 17*s* and 17*o* have to be in alignment with switch contacts 12*s* and 12*o* so that either leg 23*l* or 23*r* can be urged into contact with either contact 12*s* or 12*o* substantially in the manner as previously described. Resilient washers 26*l* and 26*r* are provided about legs 23*l* and 23*r*, respectively, for sealing off the holes and for providing spring-like return of panel rocker 20*n* after it is appropriately manually pressed. Decorative cap 24*n* may be attached to the top surface of actuator bar 32*n* of rocker switch 20*n* and spring panel 30*n* may be attached to legs 23*l* and 23*r* in the manner described above.

As described in the first embodiment, FIG. 6 shows that switching occurs through lens 18*n* when rocker panel switch 20*n* is appropriately pressed for urging legs 23*l* and 23*r* into contact with switch contacts 12*s* and 12*o*, respectively. Holes 17*s* and 17*o*, which receive legs 23*l* and 23*r*, are in the bottom of lens recess 18*r* but are in the lens rather than in platform 14*b* as described in the first embodiment and shown in FIG. 1*a*. Alignment of holes 17*s* and 17*o* with switch contacts 12*s* and 12*o* is facilitated since alignment only has to occur between two watch components and not among three or more as in the first embodiment. Since the lens covers substantially the entire top surface of the watch assembly in FIG. 6, an all-glass appearance is provided which still requires for switching and setting of watch functions to occur with a rocker panel switch thru lens 18*n* as in the first embodiment. The top of actuator bar 32*n* fits within lens recess 18*r* to provide for manual switching operation and has sufficient clearance from the walls "8*w*" of the recess to allow for slight misalignment of holes 17*s* and 17*o* with switch contacts 12*s* and 12*o*, respectively.

In this case, bottom surface 27*d* of lens 18*n* is printed with a decorative design to prohibit the interior of the watchcase, i.e., module 12*n*, from being seen through the crystal. The printed design does not obstruct the view of display 11*d*.

Except for the differences noted above between the first watch assembly of FIGS. 1 thru 5 and the second watch assembly of FIGS. 6 and 7, the remainder of the description of the first watch assembly is applicable to the second watch assembly.

Furthermore, the single rocker panel of each of the first two embodiments may be replaced by at least two single rocker panels or switches, 90 and 91 as shown in FIG. 8.

FIG. 8 shows two independent recesses 90*r* and 91*r* in lens 92 each receiving single manually operated switches 90 and 91 respectively. Bezel platform 93 has holes 94 and 95 at the bottom of recesses 90*r* and 91*r* which receives legs 96 and 97 that depend from switch top members 90*t* and 91*t*, respectively. The holes may be in the platform as shown in FIG. 8 or they may be in the lens as for the embodiment shown in FIG. 6.

In any case, lens 92 is attached to bezel 98 by a watertight adhesive tape or film 99 and switching and watch function setting occurs through the watch lens or crystal.

Resilient washers 99*l* and 99*r* are provided for sealing off holes 94 and 95 respectively and for providing a spring-like return after each single switch 90 and 91 is urged into contact with switch contacts 100*l* and 100*r* in the watch electronic timekeeping module (not shown). A spring bar 101 may be connected to the legs of each independently actuated switch in the manner described above.

It will be apparent to those skilled in the art that the rocker switch of the invention can be used with other electrical devices such as clocks, calculators, and the like.

What is claimed is:

1. In a timepiece including a case and a module with time display means and switch contact means inside said case, the combination of:

(a) a substantially flat platform on the top of said case including an aperture for viewing said time display means and a pair of spaced apart holes in said platform providing access to said switch contact means inside said case, said platform being defined by frame members extending along opposite sides thereof forming an open-ended platform recess therebetween, (b) a crystal member having a substantially flat side disposed over substantially the entire surface area of said platform between said frame members, said crystal having at least one opening therein surrounding said holes, thereby defining at least one crystal recess with said holes in the bottom thereof, (c) doubly coated adhesive gasket disposed in the area between the crystal and the platform attaching the same together and sealing against moisture entry into said case, (d) a manually-operable actuator bar, free from contact with said crystal member, disposed in and projecting through said crystal recess having an accessible top side by which said bar can be manually pressed and having a second side spaced from and facing the platform at the bottom of said recess, and having a pair of legs projecting from said second side through said holes, such that at least one leg is urged into direct contact with said switch contact means by pressing said bar without exerting force on said crystal member, (e) retaining means cooperating with each leg and said platform for retaining said bar in said crystal recess, and (f) resilient washer means disposed around each leg between the second side of said actuator bar and the platform at the bottom of said recess with portions of the washer means in contact with said second side and the platform in said recess bottom to provide sealing action and return-spring action for the actuator bar.

* * * * *